United States Patent [19]

Nagano et al.

[11] Patent Number: 4,941,652

[45] Date of Patent: Jul. 17, 1990

[54] BICYCLE TYPE TRAINING MACHINE

[75] Inventors: Masakazu Nagano; Katsuya Nakagawa; Yoshiaki Nakanishi, all of Kyoto, Japan

[73] Assignee: Nintendo Co., Ltd., Kyoto, Japan

[21] Appl. No.: 152,976

[22] Filed: Feb. 8, 1988

[30] Foreign Application Priority Data

Feb. 9, 1987 [JP] Japan ..... 62-028980

[51] Int. Cl.[5] ..... A63B 69/16; A63B 21/00; A63B 23/04

[52] U.S. Cl. ..... 272/73; 272/129; 272/DIG. 6

[58] Field of Search ..... 272/73, 129, DIG. 6; 318/370

[56] References Cited

U.S. PATENT DOCUMENTS

| | | | |
|---|---|---|---|
| 4,084,810 | 4/1978 | Forsman | 272/DIG. 6 X |
| 4,358,105 | 11/1982 | Sweeney, Jr. | 272/73 |
| 4,452,445 | 6/1984 | Csekes | 272/129 X |
| 4,519,603 | 5/1985 | DeCloux | 272/73 |
| 4,613,129 | 9/1986 | Schroeder et al. | 272/73 |
| 4,616,823 | 10/1986 | Yang | 272/73 |
| 4,678,182 | 7/1987 | Wakao et al. | 272/73 |
| 4,713,567 | 12/1987 | Fey et al. | 272/73 X |

FOREIGN PATENT DOCUMENTS

| | | | |
|---|---|---|---|
| 2532854 | 3/1984 | France | 272/73 |
| 0176962 | 4/1986 | Japan | 272/73 |
| 0193286 | 9/1986 | Japan | 272/73 |
| 1321655 | 6/1973 | United Kingdom . | |
| 1436495 | 5/1976 | United Kingdom . | |
| 2016934A | 9/1979 | United Kingdom . | |

*Primary Examiner*—Richard J. Apley
*Assistant Examiner*—Joe H. Cheng
*Attorney, Agent, or Firm*—Nixon & Vanderhye

[57] ABSTRACT

A bicycle type training machine includes a crank arm secured to a rotation shaft, pedals being attached to the both free ends of the crank arm. A rotation shaft of a generator is coupled to the rotation shaft of the crank arm. Data of load amount to be loaded to the rotation shaft of the crank arm is outputted by a microcomputer. The load value data is then compared with a count value of a counter to which a pulse train is applied from a reference oscillator, and a pulse signal having the high level and the low level in accordance with a result of the comparison is outputted from a comparator. A duty ratio of the outputted pulse signal is decided by the periods of the high level and the low level and changed in accordance with the load value data. A switching transistor electrically connected in parallel to an armature of the generator is turned-on or -off in response to the high level or the low level of the pulse signal. Braking force of the generator is changed in accordance with the duty ratio of the switching transistor. Therefore, the load that is decided by the load value data from the microcomputer is loaded to the rotation shaft of the crank arm and thus the legs of the user.

17 Claims, 6 Drawing Sheets

AT LOW LOAD STATE

AT HIGH LOAD STATE

BICYCLE TYPE TRAINING MACHINE

BACKGROUND OF THE INVENTION

1. Field of the invention

The present invention relates to a bicycle type training machine. More specifically, the present invention relates to a bicycle type training machine in which load amount or quantity of motion is controlled by variable braking force applied to a rotation shaft of a pedal crank.

2. Description of the prior art

In a bicycle, due to sufficient inertia, it is possible to smoothly move or rotate the pedals even if the pedals are located at the top dead point and/or the bottom dead point of their rotational path of travel. However, in a bicycle type training machine, since sufficient inertia can not be obtained, the foot or legs of the user must bear a change in the load amount during operation. Thus it is impossible to smoothly move or rotate the pedals when they are located at the top dead point and/or the bottom dead point of their path of travel.

One piece of prior art employs a flywheel system in order to reduce fluctuation of the load. In this system, a flywheel having a relatively large inertia value is utilized to enable the pedals to rotate smoothly. However, the flywheel system only serves to reduce the fluctuation of the load and can not control the load amount to fit to the leg strength of the user.

A training machine utilizing a braking device based on an eddy current system is disclosed in, for example, Japanese Patent Laying-open No. 60-14876 laid-open on Jan. 25, 1985. This machine overcomes some of the disadvantage of the flywheel system. However, since braking force is obtained by the eddy current, a specific electric eddy current generator is needed. Therefore, one may only use this device near a source of electrical current.

A machine circumventing the inconvenience of the above eddy current system employs a direct current motor to control the load amount, as proposed in, for example, Japanese Patent Laying-open No. 56-85365 laid-open on Jul. 11, 1981. In this prior art, the output of a direct current motor is varied as a function of the changing pedal rotation rate, thus reducing the load fluctuation.

The above described training machine simulates a constant training state but does not control the quantity of motion or the load amount. The reason is that the output of the direct current motor is varied by only the changing pedal rotation rate.

SUMMARY OF THE INVENTION

Therefore, a principal object of the present invention is to provide a bicycle type training machine capable of controlling the quantity of motion or load amount.

In brief, the present invention is a bicycle type training machine which comprises a body, a pedal crank rotatably supported to the body, pedals attached to both ends of the pedal crank, electrical braking means, connected in association with a rotation shaft of the pedal crank, for generating braking force in accordance with an electrical signal, setting means for setting a load amount, and electrical signal generating means for generating the electrical signal which is applied to the electrical braking means. The electrical signal is intermittent and high frequency. The duty ratio of the electrical signal is variable.

The desired load amount, or the load amount based on a desired quantity of motion is set by the user through the setting means. The intermittent electrical signal is generated by the electrical signal generating means based on the load amount set by the setting means. The electrical braking means is thus intermittently operated. This means that the ratio of activation to deactivation, or the duty ratio, of the electrical braking means is changed in accordance with the set load amount. The load present against the legs of the user is thus controlled to equal the load amount set by the setting means.

Because the braking force, based on the load amount or quantity of motion set by the setting means, is obtained by electrical braking means, as opposed to the systems of the conventional machines, the target value of the load amount or quantity of motion may be precisely controlled. The present invention is thus a very effective training machine.

In one embodiment, a direct current permanent magnetic field motor is utilized as a generator which serves as the electrical braking means. In accordance with the embodiment, as opposed to the machine which utilizes the eddy current braking system or the machine in which the output of the direct current motor is controlled, a discrete electric power source is not required by the electrical braking means to control the load amount.

The above described objects and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
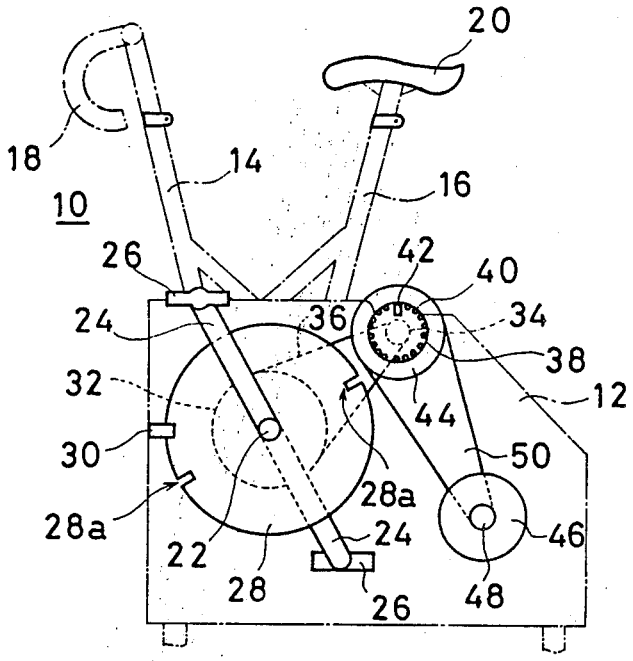
FIG. 1 is a whole illustrative view showing one embodiment in accordance with the present invention.

FIG. 1 is a whole illustrative view showing one embodiment of the present invention. A bicycle type training machine 10 includes a body 12 settled on the floor. Two pipes 14 and 16 are fixed to the upper end of the body 12 so as to be inclined in directions being opposite to each other in the front and rear. At the tip end of the front pipe 14, a handle 18 is fixed, and at the tip end of the rear pipe 16, a saddle 20, on which the user can sit, is fixed.

The body 12 includes a suitable housing or casing in which a rotation shaft 22 is supported by a suitable bearing. A pedal crank 24 is secured to the rotation shaft 22, and pedals 26 are attached to both of the fee ends of the pedal crank 24.

To the rotation shaft 22, a disk 28 having a relatively large diameter is secured. In order to reduce the weight of the disk 28, the same is made of light weight metal material such as aluminum, or a synthetic resin or the like. On the outer peripheral of disk 28, two slits 28*a* are formed at positions opposite to each other. A photosensor 30 fixed relative to said body 12 is provided at a suitable position along the outer peripheral of the disk 28 so as to be able to detect the slits 28*a*. These slits 28*a* and photosensor 30 are utilized for detecting the top dead point and bottom dead point of the pedals 26. Therefore, a physical relationship between the slits 28*a* and the photosensor 30 should be selected so that the top dead point and bottom dead point can be detected. In the embodiment shown, since the photosensor 30 is provided at the position that has an angle 90 degrees with respect to the mechanical top dead point and bottom dead point, the two slits 28 are located on a line crossing at right angles with pedal crank 24.

A gear 32 having a relatively small diameter is secured to the rotation shaft 22. A chain 36 is spanned between the gear 32 and a gear 34 which is fixed to another rotation shaft. The gear ratio of the gear 32 and the gear 34 is selected to be 1 (one) or more. Due to the gear ratio, the gear 34 is rotated at the speed of few or several times of the rotation of the pedal crank 24 (the pedals 26) and thus the gear 32. A disk 38 is fixed to the gear 34 and rotates with gear 34. On the outer peripheral of the disk 38, a plurality of throughholes 40 are formed so as to be distributed on the circle line of the disk at suitable intervals. A photosensor 42 is provided near the outer edge of the disk 38 so as to be able to detect the throughholes 40. A combination of the throughholes 40 and the photosensor 42 is utilized to detect the rotation angle of the pedal crank 24. Therefore, the gear ratio of the gears 32 and 34, the diameter of the disk 38, and the number of throughholes 40 must have a predetermined relationship by which one rotation of the pedal crank 24 is equally divided by the number of the throughholes 40. In this embodiment shown, one rotation of the pedal crank 24, that is, 360 degrees, are equally divided into two hundred four by the throughholes 40 and the photosensor 42. Therefore, signals are outputted from the photosensor 42 for each throughholes 40 in the rate of two hundred four signals per one rotation of the pedal crank 24.

To the gear 34, a wheel 44 having a diameter slightly smaller than that of the gear 32 is fixed to rotate with gear 34. A belt 50 is spanned between the wheel 44 and a rotation shaft 48 of a direct current motor 46. As the direct current motor 46, a print motor, for example, "(UG)PMFE-16AAB" manufactured by Yasukawa Electric Manufacturing Corporation may be utilized. In the print motor, a magnetic field is emitted by the permanent magnet, and an electric power source for generating a field magnetic flux is thus not necessary. In view of such an advantage, in this embodiment shown, the direct current motor 46 is utilized as the direct current generator. The dynamic braking force of the direct current generator is intermittent and of a very short period (for example 20kHz) so that the load amount is suitably controlled.

Figure 2:
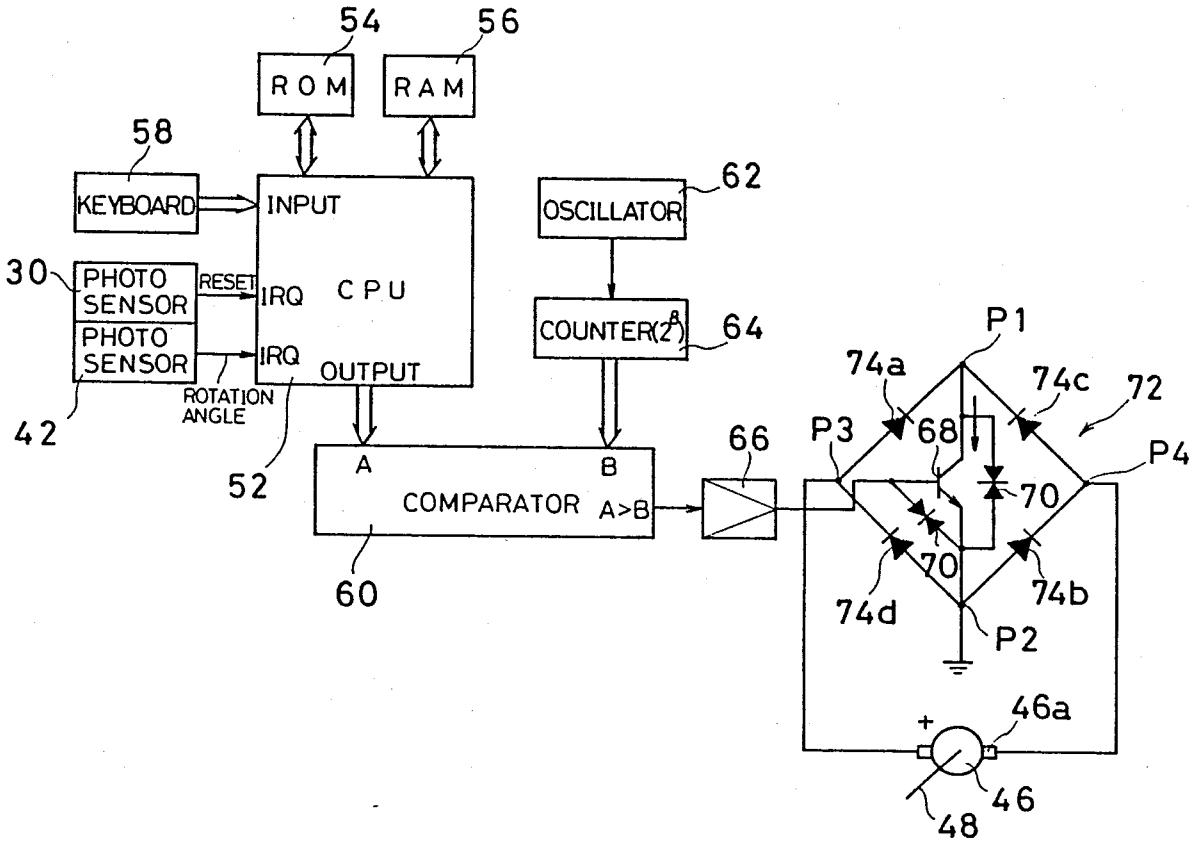
FIG. 2 is a block diagram showing a configuration of FIG. 1 embodiment.

FIG. 2 is a block diagram showing a configuration of FIG. 1 embodiment. For controlling the system, an 8-bit microcomputer (microprocessor) or CPU 52 is used. A ROM 54 for storing a control program and table described later, and a RAM 56 for storing control data, are connected to the CPU 52. Key inputs from a keyboard 58 are sent through an input port of the CPU 52. The keyboard 58 is utilized for inputting the desired quantity of motion or the desired load amount as a numerical, value and for inputting a phase value that is different for each user. The phase value is a deviation angle between the mechanical top dead point and the motional or substantive top dead point, at which the user can applied the maximum leg force to the pedal 26.

A detecting signal from the photosensor 30, which is adapted to detect the slits 28 of the disk 28, and a detecting signal from the photosensor 42, which is adapted to detect the throughholes 40 of the disk 38, are received by an interrupt input port IRQ of the CPU 52. A single reset signal is inputted from the photosensor 30 for each half rotation of the pedal crank 24, that is, for each 180 degrees, and a single rotation angle signal is outputted from the photosensor 42 for each 180/102 rotation numbers of the pedal crank 24, that is, for each approximately 1.8 degrees.

The load value is outputted from the CPU 52 as the 8-bit data so that the direct current generator 46 generates a dynamic braking force equivalent the desired motional load amount which is inputted through the keyboard 58. The data of the load value outputted from the CPU 52 is applied to a comparator 60 as one input A. An oscillator 62 is provided for generating a standard or reference clock signal having a frequency of 5 MHz, for example. An output from the oscillator 62 is applied to a counter 64 of, for example, 8-bit. Therefore, the standard or reference clock received from the oscillator 62 is frequency-divided into 256 by the 8-bit counter 64. The data of the 8-bit count value of the counter 64 is applied to the above described comparator 60 as the other input B. The comparator 60 compares two inputs A and B, and outputs a pulse signal that has a high level only when A B.

The pulse signal from the comparator 60 is applied to a base of a switching transistor 68 through a suitable amplifier 66. As an example of the switching transistor 68, the silicon NPN triplex diffusion type GTR module "MG15GlAL3" manufactured by Toshiba Corporation may be utilized. Free wheel diodes 70 connected to the switching transistor 68 are used for protecting the switching transistor 68, and are included in the above described switching module.

A collector and an emitter of the switching transistor 68 are connected to two connecting points P1 and P2, respectively, opposite each other in a diode bridge 72. The connecting point P2 is connected to the ground. To points P3 and P4, which are opposite each other in the diode bridge 72, ends of armature 46*a* of the direct current motor 46 are connected. Diodes 74*a*–74*d* are inserted in the four sides of diode bridge 72 so that a current from the armature 46*a* of the direct current motor 46 is able to flow in a constant direction (direction denoted by arrows in FIG. 2) through the switching transistor 68 irrespective of the polarity. More specifically, the diode 74*a* is connected such that the direction from the connecting point P3 to the connecting point P1 is the forward direction, the diode 74*b* is connected such that the direction from the connecting point P2 to the connecting point P4 becomes the forward direction, the diode 74*c* is connected such that the direction from the connecting point P4 to the connecting point P1 becomes the forward direction, and the diode 74*d* is connected such that the direction from the connecting point P2 to the connecting point P3 becomes the forward direction. If the diode bridge 72 is employed in the above manner, when the user rotates the pedals 26 in the reverse direction, a reverse bias can not be applied to the transistor 68 and the transistor 68 is thus not destroyed. Note that a dynamic braking force similar to the force present during forward rotation is still obtainable.

Figure 3A:
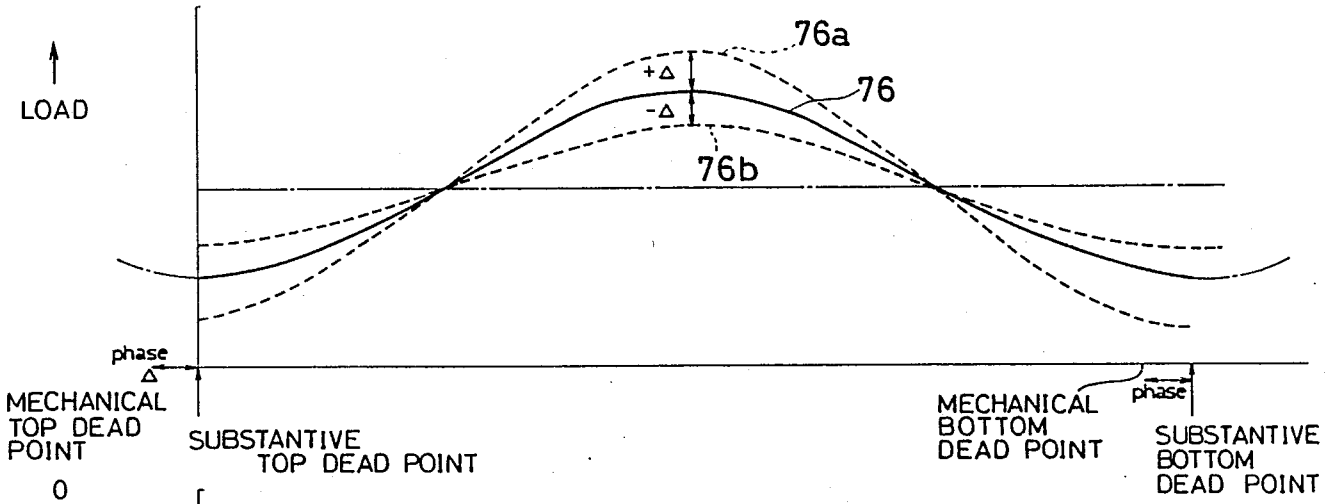
FIG. 3 is a waveform diagram showing a relationship between load curve and load value.

Next, based on FIG. 3 and with reference to FIGS. 1 and 2, a description will be made on the control principle of this embodiment. In general, the load against the user's legs is changed based on a load curve 76, as shown in FIG. 3A, between the motional or substantive top dead point to the bottom dead point. In order to produce smooth rotation of the pedals 26, and the pedal crank 24 based on the load curve 76, the direct current motor 46 produces a load value of inverse proportion to the load curve 76. The load against to the user's legs is thus approximately constant at all positions of the pedal crank 24, and the rotation of the pedal crank is smooth.

Figure 3B:
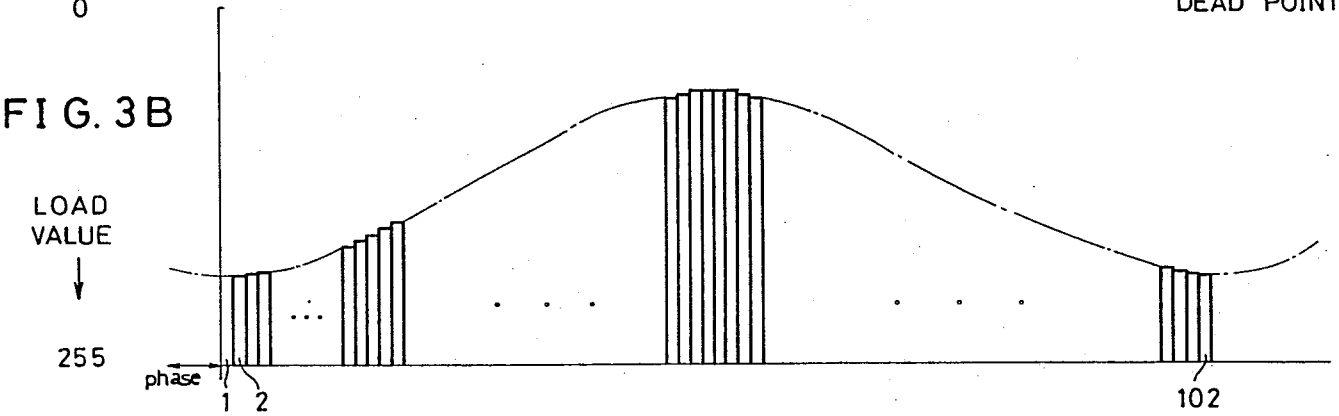

To obtain the above control, "load value" represented by the numeral values "0–255", as shown in FIG. 3B, is stored in tabular form in the ROM 54 associated with the CPU 52 based on the rotation of the pedal crank 24 in intervals of 1.8 degrees (which is a result of 180/102). Then, the CPU 52 reads data from the table of the ROM 54 for each interrupt signal (IRQ) from the photosensor 42 and converts this read data into load value data based on the degree value of the pedal crank 24. This converted data is applied to the comparator 60. The count value of "0–255" of the counter 64 is sequentially applied to the other input of the comparator 60 for each standard or reference clock from the oscillator 62. If the count value of the counter 64 becomes larger than the load value from the CPU 52, the high level signal is outputted from the comparator 60. Therefore, if A B, the switching transistor 68 is turned-on and the both ends of the armature 46*a* of the direct current motor 46 is short-circuited through the diode bridge 72 and the switching transistor 68. More specifically, the armature 46*a* of the direct current motor 46 is short-circuited through the connecting point P3 of the diode bridge 72, the diode 74*a*, the connecting point P1, the switching transistor 68, the connecting point P2, the diode 74*b* and the connecting point P4, when the polarity of the current is +(plus). The armature 46 is short-circuited through the connecting point P4, the diode 74*c*, the connecting point P1, the switching transistor 68, the connecting point P2, and the diode 74*d* and the connecting point P3, when the polarity of the current is −(minus). When the armature 46*a* of the direct current motor 46 is short-circuited, the dynamic braking force is produced by the direct current motor 46.

In this embodiment, the above described short-circuiting of the armature 46*a* of the direct current motor 46 is intermittently repeated in short time intervals to change the duty ratio of the dynamic braking force. Thus, the motional load amount operating against the user is altered to attain the set value or target value set through the keyboard 58. In addition to the instantaneous change of the duty ratio, the short time interval may be changed stepwise.

Figure 4A:
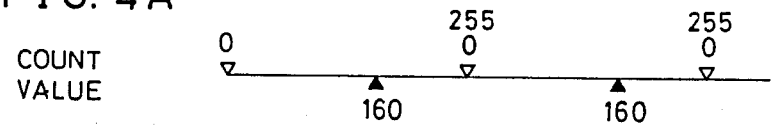
FIGS. 4 and 5 are illustrative views showing generation of braking force at the low load state and high load state, respectively.
Figure 4B:
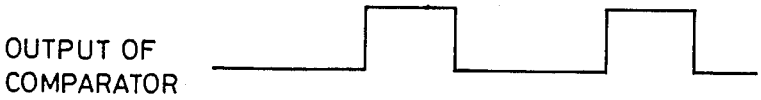
Figure 4C:
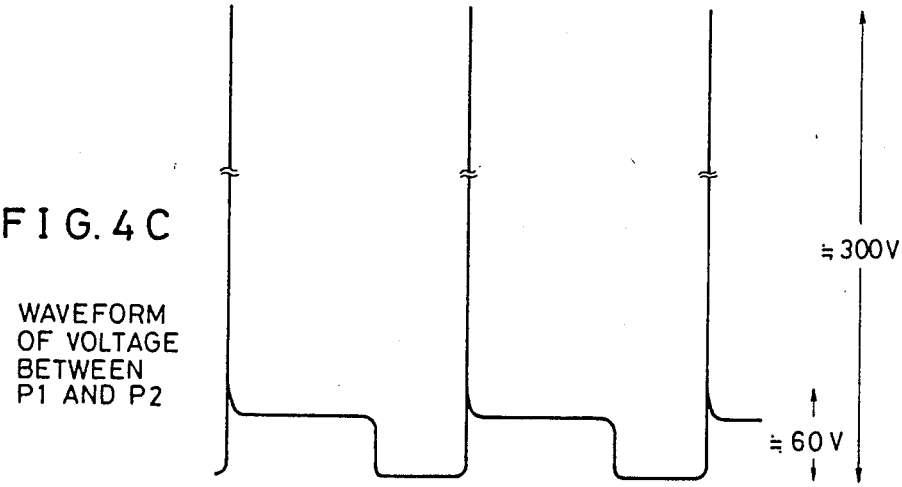
Figure 4D:
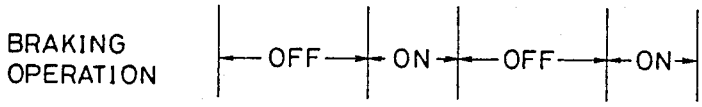
Figure 5A:
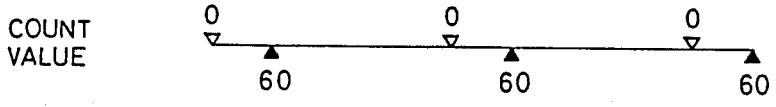
Figure 5B:
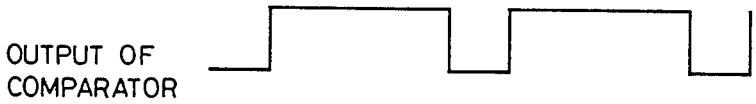
Figure 5C:
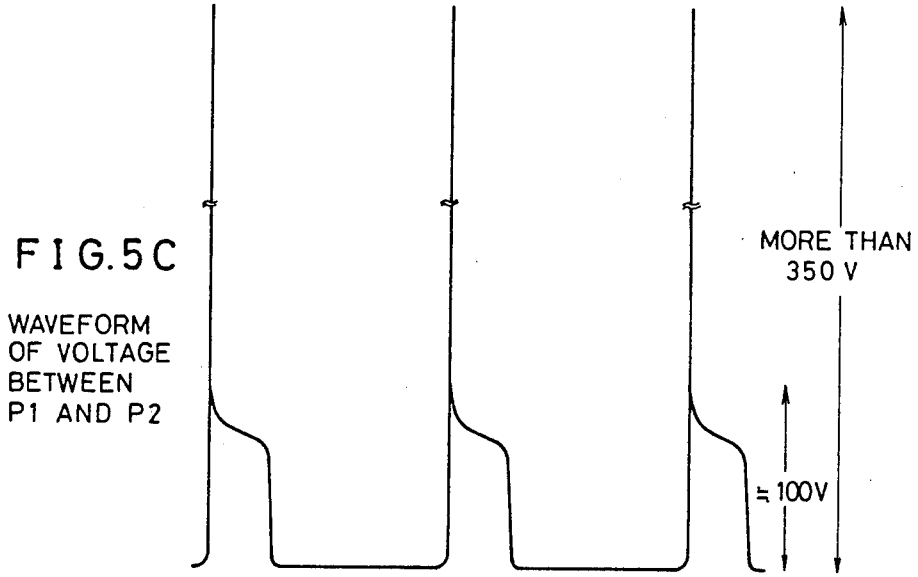
Figure 5D:
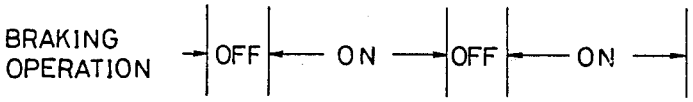

Assume that "160" is set as the load value from the CPU 52 at "low load state". The count value of the counter 64 is changed "0–255" for each reference clock from the oscillator 62 as shown in FIG. 4A. When the count value of the counter 64 is smaller than the load value "160" set by the CPU 52, as shown in FIG. 4B, the output of the comparator 60 is the low level. In that state, the switching transistor 68 is turned off. After transition voltage of about 300V, a voltage of about 60V is applied between the connecting points P1 and P2 of the diode bridge 72, that is, between the input and output terminals of the switching transistor 68, as shown in FIG. 4C.

Thereafter, if the count value of the counter 64 is incremented and reaches the load value "160" set by the CPU 52, the high level signal is outputted from the comparator 60 as shown in FIG. 4B. Accordingly, the switching transistor 68 is turned-on and the input and output terminals of the transistor 68, that is, the connecting points P1 and P2 of the diode bridge 72, are short-circuited. At this time, the voltage between the connecting points P1 and P2 becomes approximately "0" as shown in FIG. 4C. This means that in this time period, the dynamic braking force is obtained by the direct current motor 46. If the count value of the counter 64 is further incremented and becomes again "0", A is no longer B and the low level is again outputted from the comparator 60 as shown in FIG. 4B. Thus, during a round count value of "0–255" of the counter 64, the dynamic braking force is produced by the direct current motor 46 only one time. In this embodiment shown, the reference clock of 5MHz is frequency-divided into "256", and therefore the dynamic braking force is obtained one time for approximately each 51 micro-seconds. Thus, since the dynamic braking force is activated and deactivated at relatively short time intervals, the user does not feel the pedals 26 and the pedal crank 24 jerk. When the dynamic braking force is applied, the on/off duty ratio of the dynamic braking is changed in accordance with the load value set by the CPU 52.

Assume that "60" is outputted from the CPU 52 as the load value in a "high load state" as shown in FIG. 5. In this case, the output of the comparator 60 is a pulse which is at a low level when the count value of the counter 64 is "0–59" and is at a high level when the count value is "60–255" as shown in FIG. 5B. In comparison with FIG. 4B, the braking period of approximately 51 micro-seconds does not change, but the duty ratio, or the ratio of time spent by the comparator 60 output pulse signal at a low level and at a high level, has changed.

In the case shown in FIG. 5, the armature 46*a* is short-circuited by the switching transistor 68 for a long time period. After the transition voltage of 350V or more, the voltage of approximately 1OOV is applied between the connecting points P1 and P2 of the diode bridge 72, that is, between the input and output terminals of the switching transistor 68 as shown in FIG. 5C. Then, if the switching transistor 68 is activated, as in the previous case, the voltage between the connecting points P1 and P2 becomes approximately "0". At this time, the dynamic braking force is applied to by the direct current motor 46.

Thus, the time period of the dynamic braking force applied by the direct current motor 46, that is, the on/-off duty ratio, is controlled based on the load value (digital value) outputted from the CPU 52. Hence, the motional load amount operating against to the user can be controlled.

Next, the control of the aforementioned phase value is described. As previously described, due to the length of the user's legs, the angle of foot placement on the pedal, and so on, the mechanical top dead point of the pedal 26 is different from the motional or substantive top dead point where the legs of the user can produce the maximum power. The degree of such a deviation also varies. Therefore, in the embodiment shown, the most suitable deviation angle, i.e. phase value can be inputted and set by the user through the keyboard 58. Then, the data of the load value initially read from the table, that is, the starting address read in response to the interrupt request IRQ, is modified or changed in accordance with the set phase angle as shown in FIG. 3.

Furthermore, since the desired quantity of motion also varies, the user can input and set the desired quantity of motion by means of the keyboard 58. On the other hand, the data of the load value according to the standard load curve 76 as shown in FIG. 3B is stored in the table (ROM 54). The CPU 52 employs an arbitrary bias amount (+) or (−), as shown in FIG. 3A, in accordance with the set quantity of motion so that the load amount, i.e. dynamic braking force by the direct current motor 46, is changed based upon the set quantity of motion. More specifically, the CPU 52 operates upon the standard data and the bias data, and outputs the load value according to the set quantity of motion or load amount.

Figure 6:
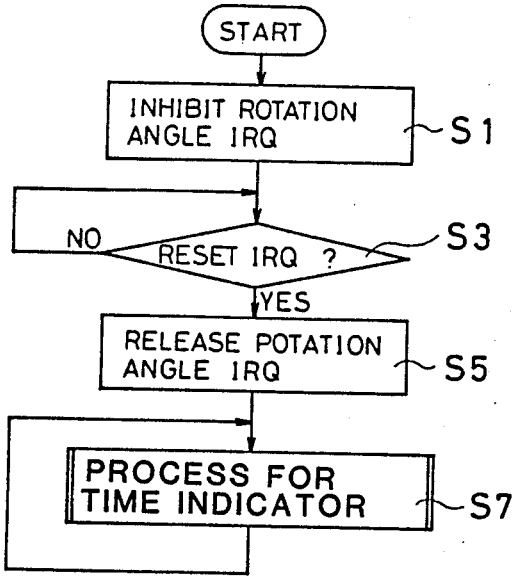
FIGS. 6 and 7 are flow charts showing specific control of the embodiment.

Next, with reference to FIGS. 6 and 7, more specific controls will be described. In the first step, S1, of the main routine shown in FIG. 6, to enable the reception of the interrupt request of the rotation angle only after the first reset interrupt request is applied, the CPU 52 initially inhibits the rotation angle interrupt request from the photosensor 42. That is, the interrupt request for each predetermined rotation angle (1.8 degrees in the embodiment) is inhibited. Then, if the interrupt request from the photosensor 30, that is, the input of the reset interrupt request, is detected in step S3, in step S5 the CPU 52 releases the rotation angle interrupt request previously inhibited. Then, in step 7, the CPU 52 functions to control a normal time indicator.

Figure 7:
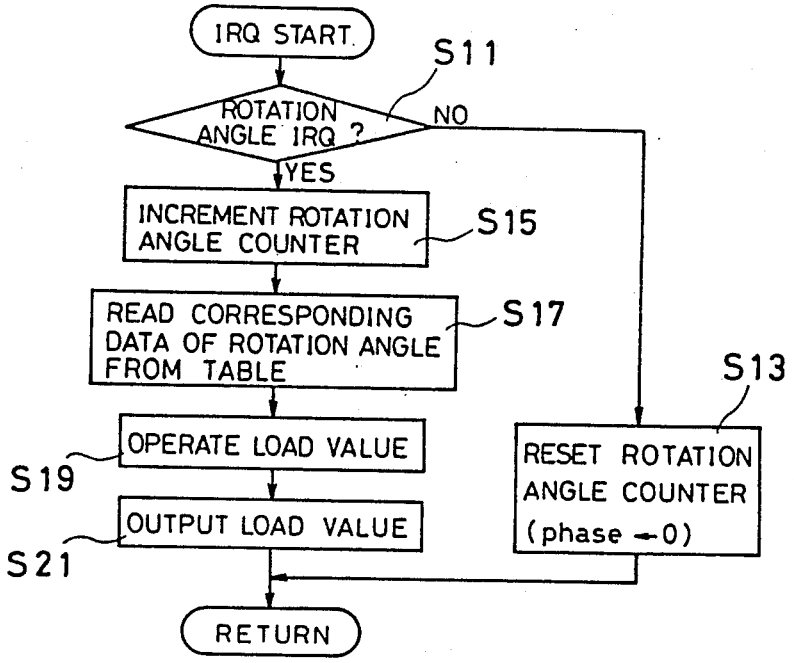

The IRQ routine as shown in FIG. 7 is initiated when the reset interrupt request or the rotation angle interrupt request is inputted to the interrupt terminal IRQ of the CPU 52. In the first step, S11, the CPU 52 determines whether or not the inputted interrupt request is the rotation angle interrupt request. If not the rotation angle interrupt request, since the rotation angle interrupt request is the reset interrupt request, the CPU 52 resets a rotation angle counter (not shown) assigned in a suitable region, area or location of the RAM 56 in step S13. If there is no deviation between the maximum power point of the motion of the user and the mechanical top dead point of the pedal crank 24 (FIG. 1), in the step S13, the CPU 52 sets the rotation angle counter to be "0". If there is a deviation between the maximum power point and the mechanical top dead point of the pedal crank 24, the rotation angle counter is initially set as "phase 0" so that the angle corresponding to the deviation angle (phase), for example, 15 degrees, becomes "0". In the step S13, the rotation angle counter is thus reset to take into consideration the deviation between the maximum power point and the mechanical top dead point of the pedal crank 24. The load value having the maximum value as shown in FIG. 3B is outputted from the CPU 52 whenever the rotation angle counter is "0".

In step S11, if the inputted interrupt request is the rotation angle interrupt request, in step S15, the CPU 52 increments the rotation angle counter assigned within the RAM 56. Thereafter, in step S17, the CPU 52 reads out the data associated with the load value at that rotation angle from the table of the ROM 54 by utilizing the count value of the rotation angle counter as the address. Thereafter, in step S19, the CPU 52 adds the bias to the data at the rotation angle read from the table. The bias is the difference in the amplitude between the load curve 76 and the load curve **76*a* or 76*b* shown in FIG. 3A, denoted by +or −, and set through the keyboard 58. More specifically, in step S19, as shown in FIG. 3B, the CPU 52 operates on the load value for each rotation angle being represented by the rotation angle counter by adding or subtracting the bias set by the keyboard 58 to or from the data read from the table of the ROM 54. In the step S21, the load value thus produced is outputted as one input of the comparator 60. Then, as previously described, the activated/deactivated duty ratio of the dynamic braking force of the direct current motor 46 is controlled based on the load value and the count value of the counter 64**.

In addition, in step S19, note that the bias amount to be added or subtracted is not constant throughout all rotation angle of the pedal crank 24, the bias amount is data that increases or decreases in accordance with the rotation angle of the pedal crank 24, as shown in FIG. 3A.

Furthermore, the photosensors described in the aforementioned embodiment may be modified one of many types of sensor such as an electrostatic system, magnetic system and so on.

Furthermore, in the aforementioned embodiment, the semiconductor switching means is composed of the diode bridge 72 and the switching transistor 68. However, the semiconductor switching means may be reversibly connected in parallel with each other.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bicycle type training machine, comprising:

a body;

a pedal crank, rotatably support on said body, having two ends and including pedals attached on to each end;

rotation angle detecting means provided on said body for detecting a rotation angle of said pedal crank;

data generating means, responsive to said detecting means, for generating desired load data;

a reference clock signal generation for generating a reference clock signal;

counter means which receives said reference clock signal;

comparing means which compares said desired load data from said data generating means with a counted value of said counter means; and electrical braking means, linked to said pedal crank and responsive to said comparing means, for generating a braking force, wherein said electrical, braking means includes pulse generating means for generating a pulse having a duty ratio, said duty ratio comprising relative time periods of a first level and a second level of a pulse in accordance with said desired load data.

2. A bicycle type training machine in accordance with claim 1, wherein said electrical braking means includes a generator having an armature having two ends, a rotation shaft coupled in association with said pedal crank, and short-circuiting means for substantially short-circuiting said armature of said generator in response to one of said first level and said second level of the pulse from said pulse generating means.

3. A bicycle type training machine in accordance with claim 2, wherein said generator further includes a permanent magnet for generating field magnetic flux.

4. A bicycle type training machine in accordance with claim 3, wherein said short-circuiting means includes semiconductor switching means which is connected between said ends of said armature and short-circuits between the ends of said armature in response to said one of said first level and said second level of the pulse from said pulse generating means.

5. A bicycle type training machine in accordance with claim 4, wherein said semiconductor switching means includes a switching device which turns/on and/off an amature current of said armature in response to the pulse from said pulse generating means, and means for applying the armature current having a predetermined polarity to said switching device irrespective of a rotation direction of said pedal crank.

6. A bicycle type training machine in accordance with claim 1, wherein said pulse generating means includes means for generating data of said desired load in response to said rotation angle being detected by said rotation angle detecting means.

7. A bicycle type training machine in accordance with claim 2, wherein said data generating means outputs data of said desired load in response to a load curve according to said rotation angle.

8. A bicycle type training machine in accordance with claim 7, wherein said data generating means further includes means for outputting data of said desired load in response to at least one of said load curve and an user condition data.

9. A bicycle type training machine, comprising:

a body;

a pedal crank, rotatably supported on said body, having two ends and including pedals attached one to each end;

rotation angle detecting means provided on said body for detecting a rotation angle of said pedal crank within one rotation of said pedal crank;

data generating means, responsive to said detecting means, for sequentially generating load data, said load data varies in response to a detected rotation angle during one rotation of said pedal crank; and electrical braking means, linked to said pedal crank and responsive to said load data, for generating a braking force.

10. A bicycle type training machine, comprising:

a body;

a pedal crank, rotatably supported on said body, having two ends and including pedals attached one to each end;

means for setting a desired load amount;

electrical signal generating means, responsive to said means for setting, for generating an electrical signal intermittent in high frequency with a variable duty ratio, said electrical signal generating means including pulse generating means for generating a pulse having a variable duty ratio, said duty ratio comprising relative time periods of a first level and a second level of said pulse determined in accordance with said desired load amount; and electrical braking means, linked to said pedal crank and responsive to said pulse generating means, for generating a braking force, said electrical braking means including a generator having an armature, a rotation shaft mechanically coupled with said pedal crank, and short-circuiting means for substantially short-circuiting said armature of said generator in response to one of said first level and second level of said pulse from said pulse generating means.

11. A bicycle type training machine in accordance with claim 10, wherein said generator further includes a permanent magnet for generating field magnetic flux.

12. A bicycle type training machine in accordance with claim 10, wherein said short-circuiting means includes semiconductor switching means which is connected to said armature and short-circuits said armature in response to said one of said first level and said second level of the pulse from said pulse generating means.

13. A bicycle type training machine in accordance with claim 12, wherein said semiconductor switching means includes a switching device which turns on and off an armature current of said armature in response to the pulse from said pulse generating means, and means for applying the armature current having a predetermined polarity to said switching device irrespective of a rotation direction of said pedal crank.

14. A bicycle type training machine in accordance with claim 10, wherein said pulse generating means includes data outputting means for outputting data of desired load in accordance with load amount set by said setting means, counter means responsive to a reference clock, and comparing means for comparing said desired load from said data outputting means with a count value of said counter means and outputting said pulse.

15. A bicycle type training machine in accordance with claim 14, further comprising rotation angle detecting means, provided on said body, for detecting a rotation angle of said pedal crank, wherein said electrical signal generating means further includes means for generating data of said desired load in response to said rotation angle being detected by said rotation angle detecting means.

16. A bicycle type training machine in accordance with claim 15, wherein said electrical signal generating means outputs data of said desired load in response to a load curve according to said rotation angle.

17. A bicycle type training machine in accordance with claim 21, wherein said electrical signal generating means further includes means for outputting data of said desired load in response to said load curve and an user condition data.

* * * * *